US007479896B2

(12) United States Patent
Ho et al.

(10) Patent No.: US 7,479,896 B2
(45) Date of Patent: Jan. 20, 2009

(54) ADAPTIVE CHANNEL BANDWIDTH IN AN ELECTRONIC TOLL COLLECTION SYSTEM

(75) Inventors: Thua Van Ho, Mississauga (CA); Daniel Terrier, Toronto (CA)

(73) Assignee: Mark IV Industries Corp., Mississauga, Ontario (CA)

( * ) Notice: Subject to any disclaimer, the term of this patent is extended or adjusted under 35 U.S.C. 154(b) by 301 days.

(21) Appl. No.: 11/534,073

(22) Filed: Sep. 21, 2006

(65) Prior Publication Data

US 2007/0063872 A1 Mar. 22, 2007

Related U.S. Application Data

(60) Provisional application No. 60/718,742, filed on Sep. 21, 2005, provisional application No. 60/718,743, filed on Sep. 21, 2005, provisional application No. 60/718,744, filed on Sep. 21, 2005.

(51) Int. Cl.
*G08G 1/00* (2006.01)

(52) U.S. Cl. ..... 340/928; 340/907

(58) Field of Classification Search ..... 340/928, 340/907, 572.1

See application file for complete search history.

(56) References Cited

U.S. PATENT DOCUMENTS

| | | | |
|---|---|---|---|
| 4,104,630 | A | 8/1978 | Chasek |
| 4,303,904 | A | 12/1981 | Chasek |
| 4,870,419 | A | 9/1989 | Baldwin et al. |
| 4,937,581 | A | 6/1990 | Baldwin et al. |
| 5,086,389 | A | 2/1992 | Hassett et al. |
| 5,132,687 | A | 7/1992 | Baldwin et al. |
| 5,144,553 | A | 9/1992 | Hassett et al. |
| 5,164,732 | A | 11/1992 | Brockelsby et al. |
| 5,196,846 | A | 3/1993 | Brockelsby et al. |
| 5,253,162 | A | 10/1993 | Hassett et al. |
| 5,266,947 | A | 11/1993 | Fujiwara et al. |
| 5,289,183 | A | 2/1994 | Hassett et al. |
| 5,310,999 | A | 5/1994 | Claus et al. |
| 5,351,187 | A | 9/1994 | Hassett |
| 5,424,727 | A | 6/1995 | Shieh |
| 5,425,032 | A | 6/1995 | Shloss et al. |

(Continued)

FOREIGN PATENT DOCUMENTS

| | | |
|---|---|---|
| WO | WO 9933027 | 7/1997 |

OTHER PUBLICATIONS

Jeffrey Zhu, System and Method for Secure Mobile Commerce, U.S. Appl. No. 10/912,997, filed Aug. 16, 2004.

(Continued)

*Primary Examiner*—Jeff Hofsass
*Assistant Examiner*—Kerri L McNally
(74) *Attorney, Agent, or Firm*—Hanley, Flight & Zimmerman, LLC

(57) ABSTRACT

A method and system for adaptively allocating bandwidth in an electronic toll collection system. The system includes a reader that adapts the scanning time allocated to specific antennas based upon the traffic conditions. Those antennas that process a higher volume of traffic receive a greater allocation of the scanning time. In some embodiments, the determination as to when to allocate additional time to an antenna may be based upon whether or not a transponder is currently in the coverage zone for the antenna.

16 Claims, 13 Drawing Sheets

U.S. PATENT DOCUMENTS

| | | | | |
|---|---|---|---|---|
| 5,485,520 | A | 1/1996 | Chaum et al. | |
| 5,525,991 | A | 6/1996 | Nagura et al. | |
| 5,602,375 | A | 2/1997 | Sunahara et al. | |
| 5,640,156 | A | 6/1997 | Okuda et al. | |
| 5,648,767 | A | 7/1997 | O' Connor et al. | |
| 5,657,008 | A | 8/1997 | Bantli | |
| 5,675,342 | A | 10/1997 | Sharpe | |
| 5,701,127 | A | 12/1997 | Sharpe | |
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,872,525 | A | 2/1999 | Fukasawa et al. | |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,042,008 | A | 3/2000 | Ando et al. | |
| 6,081,718 | A | 6/2000 | Ando et al. | |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 | 4/2001 | Terrier et al. | |
| 6,390,365 | B1 | 5/2002 | Karasawa | |
| 6,616,034 | B2 | 9/2003 | Wu et al. | |
| 6,661,339 | B2 | 12/2003 | Muirhead | |
| 6,661,352 | B2 | 12/2003 | Tiernay et al. | |
| 6,690,293 | B2 | 2/2004 | Amita | |
| 6,725,014 | B1 | 4/2004 | Voegele | |
| 6,898,753 | B2 | 5/2005 | Bonifas | |
| 6,943,678 | B2 | 9/2005 | Muirhead | |
| 7,349,669 | B2 * | 3/2008 | Toyama | 455/66.1 |
| 7,385,525 | B2 * | 6/2008 | Ho et al. | 340/928 |
| 2001/0050922 | A1 | 12/2001 | Tiernay et al. | |
| 2003/0001755 | A1 * | 1/2003 | Tiernay et al. | 340/928 |
| 2005/0237184 | A1 | 10/2005 | Muirhead | |
| 2005/0241548 | A1 | 11/2005 | Muirhead | |
| 2006/0071816 | A1 | 4/2006 | Tang et al. | |
| 2006/0176153 | A1 | 8/2006 | Tang | |
| 2006/0220794 | A1 | 10/2006 | Zhu | |
| 2006/0243174 | A1 | 11/2006 | Muirhead | |
| 2006/0255967 | A1 | 11/2006 | Woo et al. | |
| 2006/0255968 | A1 | 11/2006 | Woo et al. | |
| 2007/0137531 | A1 * | 6/2007 | Muirhead | 108/51.3 |

OTHER PUBLICATIONS

Tang et al., Method and System for Obtaining Traffic Information Using Transponders, U.S. Appl. No. 11/284,277, filed Nov. 21, 2005.

Ho et al., Compact Transponder Antenna, U.S. Appl. No. 11/388,737, filed Mar. 24, 2006.

Ho et al., Dynamic Timing Adjustment in an Electronic Toll Collection System, U.S. Appl. No. 11/176,758, filed Jul. 7, 2005.

Tang et al., Method of Enabling Two-State Operation of Electronic Toll Collection System, U.S. Appl. No. 11/437,236, filed May 19, 2006.

Van Ho et al., Monitoring and Adjustment of Reader in an Electronic Toll Collection System, U.S. Appl. No. 11/534,060, filed Sep. 21, 2006.

Van Ho et al., Transceiver Redundancy in an Electronic Toll Collection System, U.S. Appl. No. 11/534,052, filed Sep. 21, 2006.

* cited by examiner

ADAPTIVE CHANNEL BANDWIDTH IN AN ELECTRONIC TOLL COLLECTION SYSTEM

CROSS-REFERENCE TO RELATED APPLICATIONS

The present application claims priority to U.S. provisional patent application Ser. No. 60/718,742, U.S. provisional patent application Ser. No. 60/718,743, and U.S. provisional patent application Ser. No. 60/718,744, all filed Sep. 21, 2005.

FIELD OF THE INVENTION

The present invention relates to electronic toll collection systems and, in particular, an electronic toll collection system with dynamically adaptive channel bandwidth.

BACKGROUND OF THE INVENTION

Electronic toll collection systems conduct toll transactions electronically using RF communications between a vehicle-mounted transponder (a "tag") and a stationary toll plaza transceiver (a "reader"). An example of an electronic toll collection system is described in U.S. Pat. No. 6,661,352 issued Dec. 9, 2003 to Tiernay et al., and owned in common with the present application. The contents of U.S. Pat. No. 6,661,352 are hereby incorporated by reference.

In a typical electronic toll collection (ETC) system, a set of antennas are disposed to cover the roadway with overlapping coverage zones. Each antenna broadcasts a wakeup or trigger RF signal within its coverage zone. A tag on a vehicle passing through the coverage area or zone detects the wakeup or trigger signal and responds with its own RF signal. The tag responds by sending a response signal containing information stored in memory in the transponder, such as the transponder ID number. The response signal is received by the antenna.

The antennas operate under the control of a reader that typically uses time multiplexing to scan the roadway for transponders using each antenna in turn. When an antenna receives a response signal, the response signal is input to the reader, which may then conduct an electronic toll transaction, such as by debiting a user account associated with the transponder ID number. The reader may then cause the antenna to broadcast a programming RF signal to the tag. The programming signal provides the tag with updated information for storage in its memory. It may, for example, provide the tag with a new account balance.

The scanning pattern in a typical electronic toll transaction system allocates a fixed length time slot to each antenna. The pattern is cyclical and each cycle includes a sequence of time slots, such that each antenna is used to poll for transponders in its coverage zone once during each cycle. The sequence is then repeated in the next cycle.

It would be advantageous to have an improved method and system for obtaining traffic information using transponders.

SUMMARY OF THE INVENTION

The present invention provides a method and system for adaptively allocating bandwidth in an electronic toll collection system. The system includes a reader that adapts the scanning time allocated to specific antennas based upon the traffic conditions. Those antennas that process a higher volume of traffic receive a greater allocation of the scanning time. In some embodiments, the determination as to when to allocate additional time to an antenna may be based upon whether or not a transponder is currently in the coverage zone for the antenna. In some other embodiments, the determination may be based upon a longer term assessment of whether a lane associated with the antenna has a higher volume of traffic than other lanes. Information regarding the traffic volume may be obtained externally from a measurement source or internally by counting the number of transponder response signals or transactions per lane over a predefined period.

The allocation may be made within a variable length cycle, in which case the time slot length may be extended, or may be made within a fixed length cycle. In the case of the fixed length cycle, the time slot length may be increased by an amount by which one or more other time slots is reduced, which in one embodiment may amount to "stealing" a timeslot from another lane/channel.

In one aspect, the present application discloses an electronic toll collection system for conducting toll transactions with vehicles travelling in a roadway. The system includes a plurality of directional antennas, each antenna defining a coverage zone within the roadway, and a reader. The reader includes at least one transceiver for propagating an RF signal through the antennas and receiving RF response signals through the antennas, and a controller for controlling the at least one transceiver to individually excite each antenna with the RF signal in accordance with a time-multiplexed cyclical scanning pattern. The scanning pattern is configured to allocate each antenna an equal length proportion of a cycle of the scanning pattern for conducting RF communications. The controller includes an adaptive scanning module configured to dynamically modify the scanning pattern to allocate a longer proportion of at least one cycle of the scanning pattern to one of the antennas than is allocated to at least one of the other antennas on the basis of receipt of a response signal by the one of the antennas.

In another aspect, the present application discloses a method of adaptively modifying channel bandwidth in an electronic toll collection system. The system includes a plurality of antennas connected to a reader, the reader including at least one transceiver for conducting RF communications through the antennas, and the RF communications including propagating an RF signal and receiving response signals. The method includes steps of individually exciting each antenna with the RF signal in accordance with a time-multiplexed cyclical scanning pattern, the scanning pattern allocating each antenna an equal length proportion of a cycle of the scanning pattern for conducting the RF communications, receiving a response signal from a transponder through one of the antennas, and allocating a longer proportion of at least one cycle of the scanning pattern to the one of the antennas than is allocated to at least one of the other antennas.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

Figure 1:
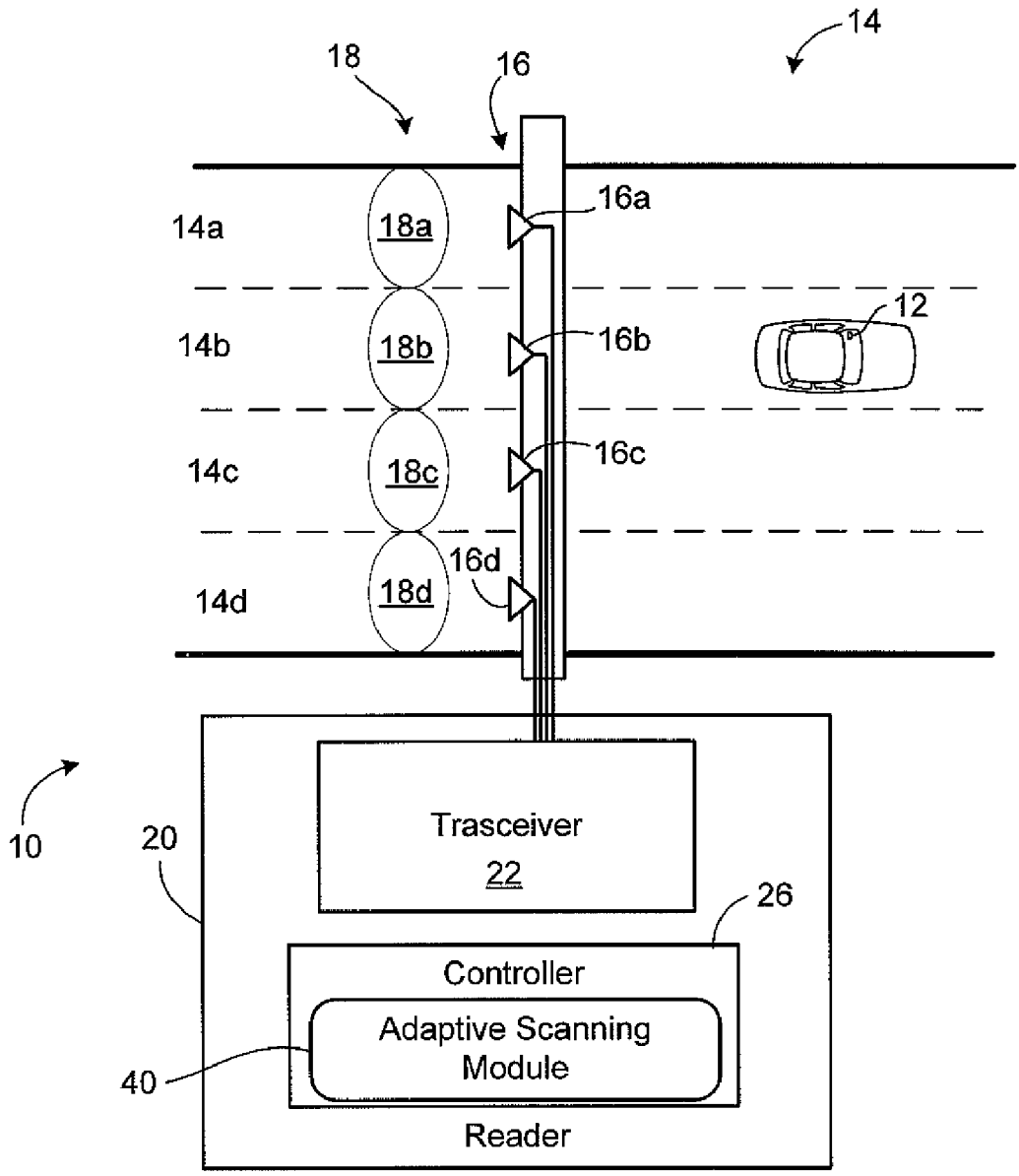
FIG. 1 shows a block diagram of an embodiment of an electronic toll collection system.

Reference is first made to FIG. 1, which shows a block diagram of an embodiment of an electronic toll collection system 10. The system 10 operates to send and receive RF communications with vehicle-borne transponders 12. In one embodiment, the system 10 is associated with a gated toll plaza. In another embodiment, the system 10 is associated with an open-road toll processing zone. Other applications for the system 10 will be appreciated by those skilled in the art.

In the embodiment shown in FIG. 1, the system 10 is associated with a multi-lane roadway 14. Individual lanes are shown as lanes 14*a*, 14*b*, 14*c*, and 14*d*.

The system 10 includes a set of antennas 16 (shown individually as 16*a*, 16*b*, 16*c*, and 16*d*). FIG. 1 shows that each antenna 16 is associated with a laneway. In particular, each antenna 16 is a directional antenna having a beam path that defines an antenna-specific capture zone 18 within the roadway 14. The antennas 16 may, in some embodiments, be mounted to an overhead gantry or other structure. In many embodiments, the antennas 16 may be positioned such that their respective capture zones 18 span the width of the roadway 14 to ensure total coverage of all lanes of traffic.

It will be appreciated that there may be more antennas 16 or fewer antennas 16 than lanes in the roadway 14. In one embodiment, midpoint antennas are also deployed defining a capture zone roughly centered at the midpoint between lanes. Other configurations will be appreciated by those skilled in the art.

The antennas 16 are connected to a roadside reader 20. The roadside reader 20 excites each antenna 16 so as to induce propagation of an RF signal in the associated capture zone 18. The antenna 16 receives incoming RF signals, which are input to the reader 20. The incoming RF signals include transmissions from any transponders within the capture zone 18. It will be appreciated that the electronic toll collection system 10 may be based upon one or more pre-defined communications protocols and may involve the use of active or backscatter transponders.

The pre-defined communications protocols used in the system 10 include propagation of a trigger signal or wake-up signal by the antennas 16 in their respective capture zones 18. Any transponder 12 within a particular capture zone 18 may respond to the trigger signal by transmitting a response signal, which is received by the antenna 16 and input to the reader 20.

In many embodiments, the reader 20 employs a time-multiplexed scan, whereby each antenna 16 is assigned a time slot within which the antenna 16 broadcasts its trigger signal and awaits a response, if any. In the embodiment depicted in FIG. 1, the protocol may provide for four time slots during which each antenna is sequentially used to poll for transponders 12 in its respective capture zone 18.

The roadside reader 20 includes a transceiver 22 and a controller 26. The transceiver 22 is configured to modulate signals from the controller 26 for transmission as RF signals over the antennas 16, and to de-modulate RF signals received by the antennas 16 into a form suitable for use by the controller 26. In one embodiment, the transceiver 22 may include a single transceiver unit and a multiplexer or switching network for connecting the transceiver unit to a selected antenna 16. In another embodiment, the transceiver 22 may include a transceiver unit dedicated to each antenna 16. In yet another embodiment, the transceiver 22 may include multiple transceivers units and a switching network for adaptively connecting the transceiver units to the antennas 16, as described in U.S. patent application Ser. No. 60/718,742 entitled "Transceiver Redundancy in an Electronic Toll Collection System filed Sep. 21, 2006, and owned in common herewith, the contents of which are hereby incorporated by reference.

The reader 20 employs hardware and signal processing techniques that will be well understood by those skilled in the art. The controller 26 may include a programmable processing unit, volatile and non-volatile memory storing instructions and data necessary for the operation of the controller 26, and communications interfaces to permit the controller 26 to communicate with the transceiver 22. The controller 26 implements the pre-defined communications protocol and controls the transceiver 22 in accordance with the scanning pattern for time-multiplexing RF communications amongst the various antennas 16. In particular, the controller 26 includes an adaptive scanning module 40 for implementing an dynamically adaptive scanning pattern, in accordance with the present invention. The adaptive scanning module 40 may be implemented in software, firmware, or any combination thereof.

Figure 2:
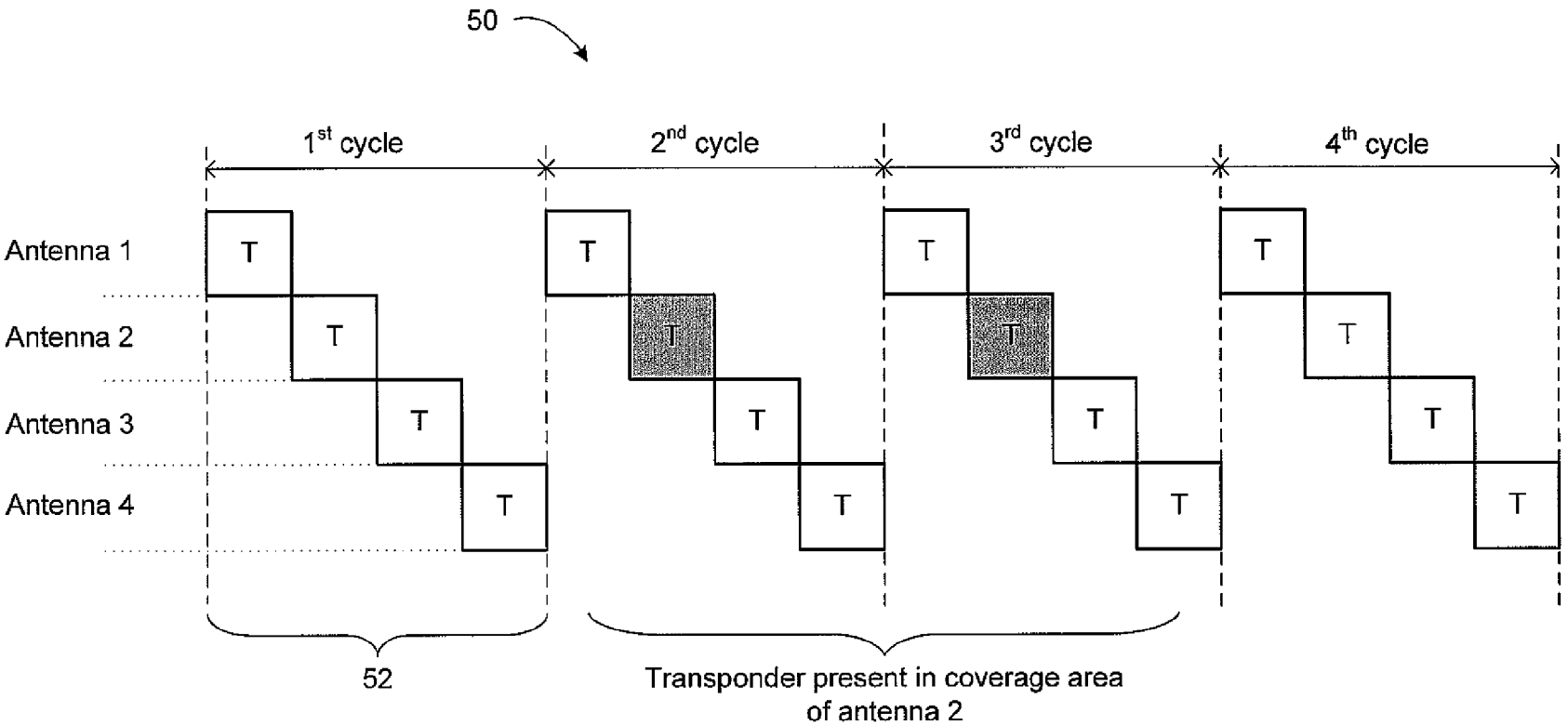
FIG. 2 diagrammatically shows an embodiment of a fixed scanning pattern used in an electronic toll collection system.

Reference is now made to FIG. 2, which diagrammatically shows an embodiment of a fixed scanning pattern 50 used in an electronic toll collection system. The fixed scanning pattern 50 shown in FIG. 2 relates to a four channel (i.e. four antenna) electronic toll collection system. It will be appreciated that other systems/patterns may have more or fewer channels.

The fixed scanning pattern 50 is cyclical, and each cycle 52 includes four equal time slots of duration T. Each channel (i.e. antenna) is allocated one of the time slots in each cycle 52 of the pattern. During its time slot, the selected antenna is used by the reader to conduct RF communications within the coverage zone of the antenna. This may include polling the coverage zone with an RF trigger signal and awaiting a response signal. It may also include transmitting a programming or write signal to the transponder, as will be explained further below. If no transponder is located in the coverage area, then no response signal will be received. If a transponder is present, then the antenna may receive a response signal. The time slot may also be used to continue communications with a transponder that was identified in the previous time slot for that antenna. For example, additional read, program, and verification cycles may be performed in accordance with the established toll communications protocol. In some cases, the RF communications are used to determine lane position, as described in U.S. patent application Ser. No. 11/176,758, filed Jul. 7, 2005, and owned in common herewith, the contents of which are hereby incorporated by reference.

FIG. 2 shows four cycles 52. Each cycle 52 is of duration 4T. During the first cycle no transponders are present in any of the coverage zones.

During the second cycle, Antenna 2 receives a response signal from a transponder located within its coverage zone, as indicated by the shaded time slot in the second cycle.

During the third cycle, the transponder is still traversing the coverage zone for Antenna 2, so RF communications with the reader through antenna 2 may continue.

During the fourth cycle, the transponder is no longer in the coverage zone or has entered a dead spot within the zone (which may occur as a result of multi-path reflections, etc.), so none of the antennas receives a response signal. It will also be appreciated that, although FIG. 2 depicts a situation in which a transponder in present in the coverage zone for two cycles, in many embodiments ETC systems are designed with coverage zones configured to ensure that transponders are present in at least one coverage zone for between three and ten cycles to ensure adequate time to conduct the ETC transaction.

It will be appreciated that, in the embodiment illustrated in FIG. 2, the duration of the cycle 52 is fixed, and each channel (antenna) is allocated a fixed portion T of the duration of each cycle 52.

Figure 3:
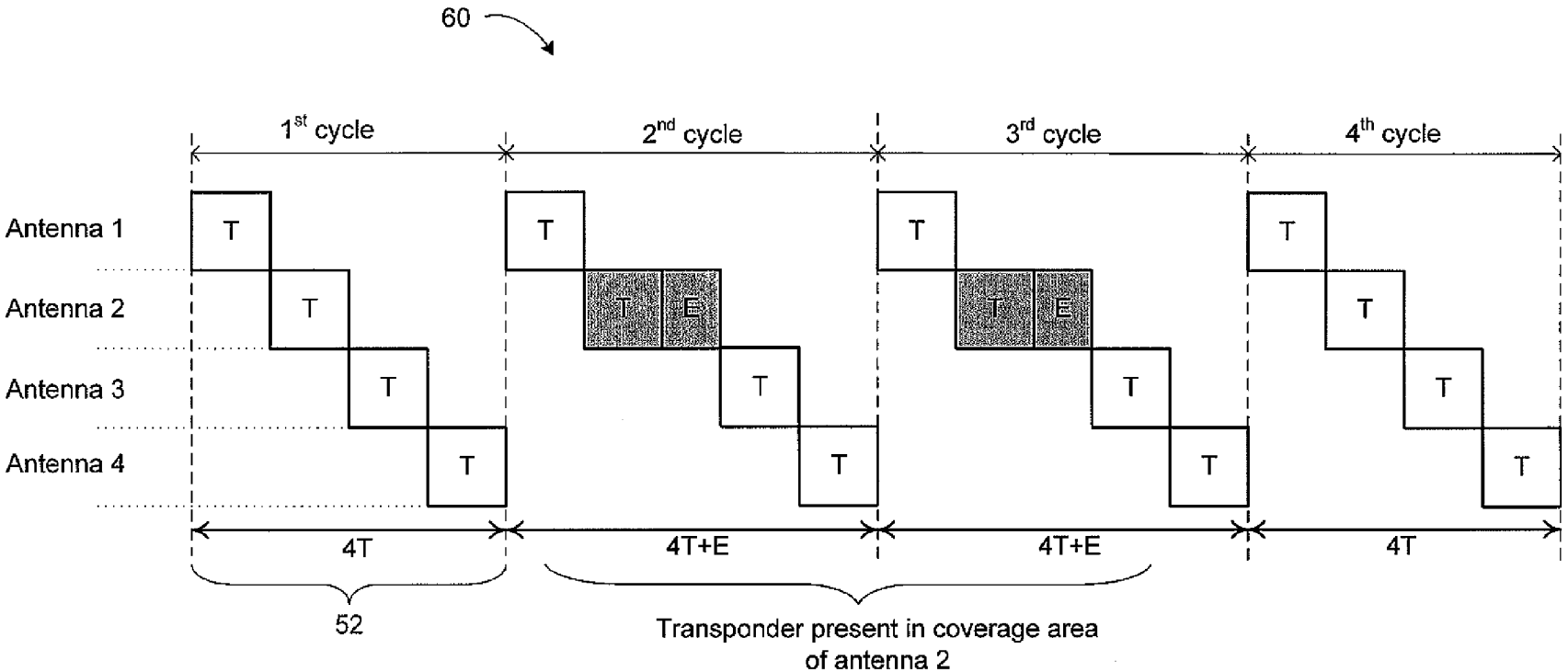
FIG. 3 diagrammatically shows an embodiment of an adaptive scanning pattern for use in an electronic toll collection system.

Reference is now made to FIG. 3, which shows an embodiment of an adaptive scanning pattern 60 for use in an electronic toll collection system.

The adaptive scanning pattern 60 uses the base cycle 52, but adapts the scanning pattern to the traffic conditions. In essence, the reader dynamically modifies the pattern to allocate a greater proportion of the scanning time to higher speed or higher volume lanes of traffic. In one embodiment, those channels that are handling RF communications with a transponder are given a larger proportion of the scanning time than those channels that are not currently handing RF communications with a transponder.

The adaptive scanning pattern 60 applies the base pattern in a cycle 52, as shown in the first cycle, unless one of the channels/antennas receives a response signal, indicating that a transponder is present in the antenna coverage zone. For example, in the second cycle Antenna 2 receives a response signal as indicated by the shaded time slot T. The reader then modifies the scanning pattern 60 to increase the time slot duration for Antenna 2, adding an extra time E to the normal duration T. Accordingly, as shown in FIG. 3, Antenna 2 has a time slot of duration T+E in the second cycle.

In the third cycle, the transponder is still present in the coverage zone for Antenna 2, so the reader again allocates a longer time slot to Antenna 2. Once the transponder is no longer present, then the scanning pattern 60 returns to the base pattern, as shown in the fourth cycle.

In this embodiment, the cycles do not have a fixed duration. If no transponders are present, the scanning pattern will have a cycle duration of 4T. If a transponder is present for one channel, then the scanning pattern will have a cycle duration of 4T+E. In a situation where transponders are present on three channels, the cycle duration may be 4T+3E. The extra time E may be more than, less than, or equal to the base time slot duration T. The extra time E may be set so as to ensure that the cycle time is not made excessively long so as not to risk missing a transponder passing through a coverage zone.

In some embodiments, the decision to extend a timeslot by the extra time E may depend on how many of the other lanes or channels also have a transponder present. In other words, if only one or two of the antennas require extended timeslots, then it may make sense to allocate that greater proportion of time to those antennas; however, if the roadway is particularly busy, then it may not make sense to extend everyone's timeslot since the net result is that every channel retains the same proportion of time but every channel has a longer timeslot.

Figure 4:
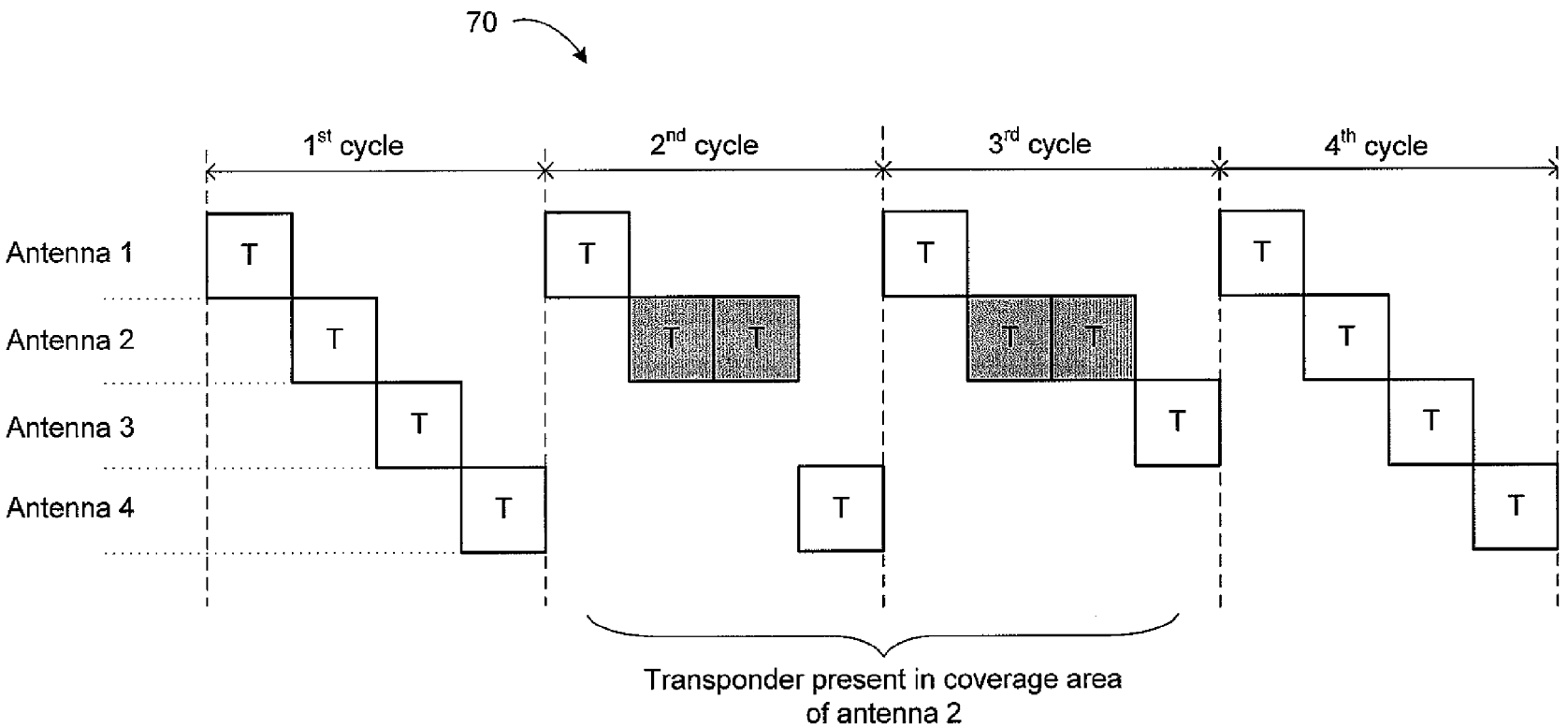
FIG. 4 shows another embodiment of an adaptive scanning pattern 70 for use in an electronic toll collection system.

Reference is now made to FIG. 4, which shows another embodiment of an adaptive scanning pattern 70 for use in an electronic toll collection system. In some embodiments, it may be desirable to maintain a fixed cycle duration within the scanning pattern. Therefore, the scanning pattern may adapt to the presence of a transponder on a first channel by allocating the first channel the time slot normally used by a second channel that does not have a transponder present. To avoid missing a transponder passing through the coverage zone of the second transponder, it will not give away its timeslot in two consecutive cycles.

As shown in FIG. 4, the scanning pattern 70 uses the base pattern wherein each of the four antennas is allocated an equal duration time slot T. In the first cycle, none of the antennas receive a response signal, meaning that no transponders are present.

In the second cycle, antenna 2 receives a response signal, as indicated by the shaded time slot T. Accordingly, the reader allocates an additional time slot T to antenna 2. It "steals" this additional time slot from an antenna that showed no transponder present in the previous cycle. In this case, the reader may "steal" the extra time slot T from antenna 3.

In the third cycle, antenna 2 again receives a response signal from the transponder present in its coverage zone. The reader again allocates an additional time slot T to antenna 2. Rather than "steal" the additional time slot from antenna 3 again, the reader "steals" the time slot T from the next antenna showing no transponder present in the most recent cycle. That antenna is antenna 4.

In this manner, the time slot allocated to an active channel is increased at the expense of the time slots allocated to inactive channels, thereby maintaining a constant scanning pattern cycle time of 4T.

In another embodiment, the determination as to when to extend the time slot for an antenna may be based upon external traffic information, rather than the presence of a transponder in the coverage zone. For example, external traffic information regarding the speed or volume of traffic in each lane of a roadway may be input to the reader. The reader may then use this information to increase the time slot length allocated to higher volume and/or higher speed lanes.

Figure 5A:
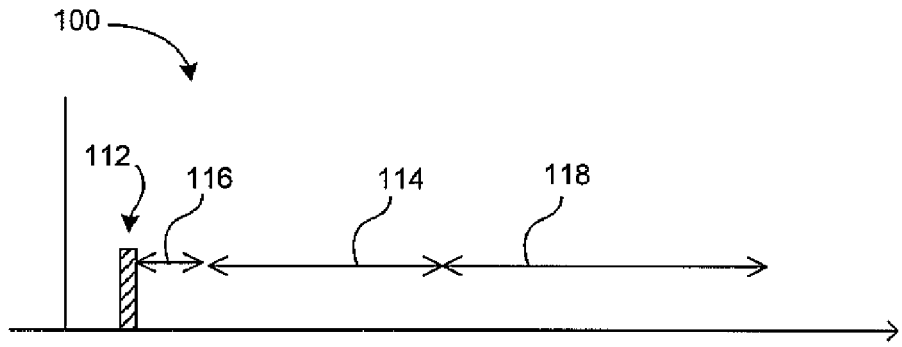
FIGS. 5A, 5B, and 5C show timing diagrams for a pre-defined communications protocol for an electronic toll collection system.
Figure 5B:
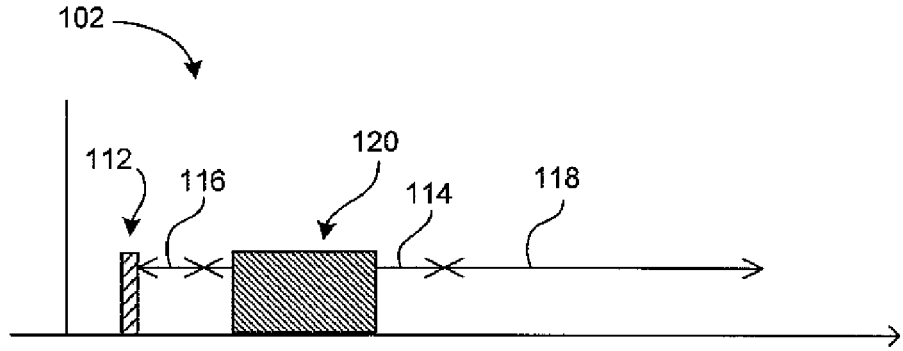
Figure 5C:
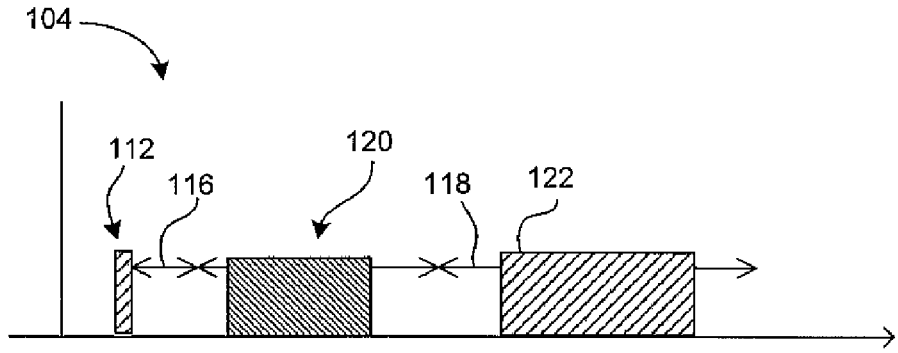

Reference is now made to FIGS. 5A, 5B and 5C, which show timing diagrams 100, 102, and 104, respectively, for an example pre-defined communications protocol for an electronic toll collection (ETC) system. The ETC system includes a reader and a transponder.

Timing diagram 100 in FIG. 5A shows a trigger signal 112 transmitted by the reader to the transponder. The reader transmits the trigger signal 112 and waits to see if a transponder in the vicinity responds to the trigger signal 112. The trigger signal 112 may be followed by a guard band during which the transponder is not to respond. The protocol may then specify a response period 114 during which the reader looks for a response signal from the transponder. The protocol may further specify a programming period 118 during which the reader may send a programming (write) signal to a transponder.

It will be understood that the trigger signal 112 may be a number of pulses, such as a rectified square wave. In another embodiment, the trigger signal 112 may be a continuous wave RF transmission. Other possible trigger signals will be apparent to those of ordinary skill in the art.

In one embodiment, the trigger signal 112 has a duration of about 20 μs, the guard band 116 has a duration of between 80 and 120 μs, the response period 114 has a duration of between 120 μs and 3 ms, and the programming period 118 has a duration of between 120 μs and 3 ms. In one particular embodiment, the guard band 116 is about 105 μs, the response period 114 is about 512 μs, and the programming period 118 is about 512 μs. In one embodiment, the transmissions between the reader and the transponder are at a carrier frequency of 915 MHz, modulated with 500 kHz data signals. In other embodiments, other frequencies may be used, including 5.9 GHz.

The timing diagram 102 of FIG. 5B shows a response signal 120 detected by the reader in response to the trigger signal 112. The reader receives, demodulates, and reads the response signal 120. The response signal 120 contains transponder information stored in memory on the transponder, including the transponder ID, vehicle data, and, possibly, account information. This may be referred to as a "read" operation. The time allocated for the program period 118 goes unutilized in this operation since the reader requires time to process the transponder information and conduct the toll transaction before formulating programming instructions to send to the transponder.

In response to the transponder information, the reader may perform a number of operations in accordance with the functions of the ETC system that will be well understood by those skilled in the art. Having performed its transaction-related functions or operations, the reader may update the transponder information and transmit instructions to the transponder directing it to update its locally stored transponder information. The timing diagram 104 in FIG. 5C shows a response signal 120 followed by a program signal 122 transmitted from the reader to the transponder. On receipt of the program signal 120, the transponder demodulates the program signal 120 to obtain program instructions, and it updates its locally stored transponder information in accordance with the program instructions. This may be referred to as a "program" operation.

The reader may then also perform a "verify" operation, which looks just like the "read" operation shown in FIG. 5B, to verify that the changes and instructions sent in the program signal 120 have been implemented by the transponder.

In a typical protocol, the reader-transponder communication may involve a read-program-verify (RPV) cycle to complete a transaction. This may mean that the reader needs to trigger the transponder three times: once to read its transponder information, a second time to read/program, and a third time to verify. In some embodiments, multiple RPV cycles may be required to complete an ETC transaction. For example, the data signals may become corrupted as a result of RF reflections or interference. Therefore, multiple attempts may be required to successfully read and program a transponder.

It will be appreciated by those of ordinary skill in the art that the present invention is not limited to pre-defined protocols having the above-detailed characteristics or timing.

Figure 6:
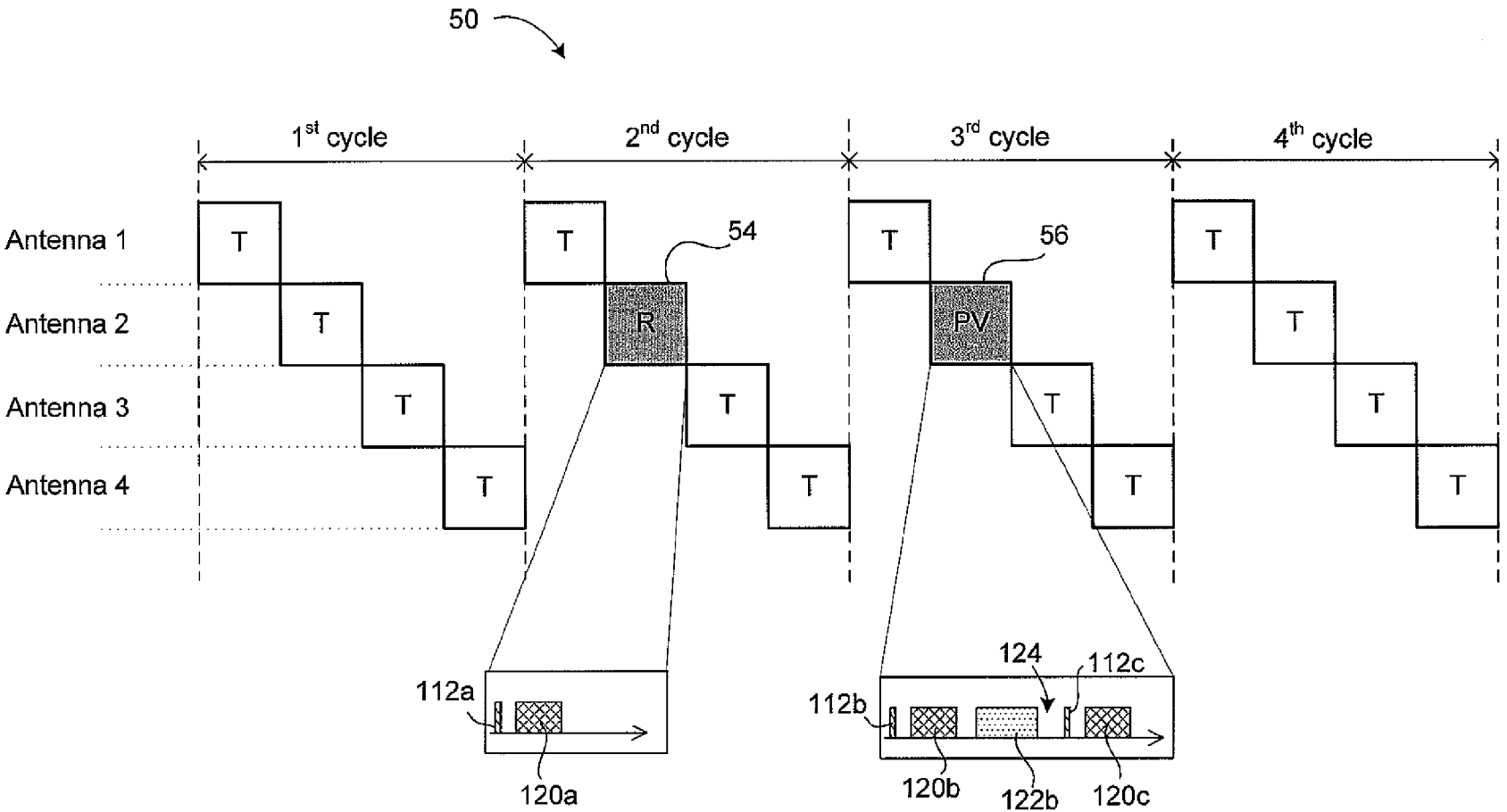
FIG. 6 shows an example using the fixed-length scanning pattern of FIG. 2.

Reference is now made to FIG. 6, which shows an example using the fixed-length scanning pattern 50. In each timeslot T, the reader transmits the trigger signal 112 (FIG. 5A) and awaits a response signal, if any. In timeslot 54 the reader sends trigger signal 112*a* and receives the response signal 120*a*. Timeslot 54 is marked with an "R" to indicate occurrence of a "read" operation. The reader then processes the information it receives in the "read" operation and, if appropriate, conducts a toll transaction by calculating a toll amount and debiting a user account. In timeslot 56, the reader again broadcasts a trigger signal 112*b* and receives the response signal 120*b* following which it transmits a program signal 122*b*. Timeslot 56 is marked with a "P" to indicate the occurrence of a "program" operation. The transponder updates its stored transponder information based upon the program signal 122*b* during a delay 124. The reader then also performs a "verify" operation by re-transmitting a trigger signal 112*c* after the delay 124. In response to the trigger signal 112*c*, the reader receives a response signal 120*c*, from which it can verify the transponder information has been updated correctly. In some instances, the "verify" operation may be performed during the same timeslot 56 as the "program" operation.

It will be appreciated that, at a minimum, in this embodiment the ETC transaction processing requires two cycles. In many cases, additional cycles may be required as a result of mis-reads, signal errors, bit errors, or other anomalies caused by multi-path, reflections, or other RF transmission problems.

Figure 7:
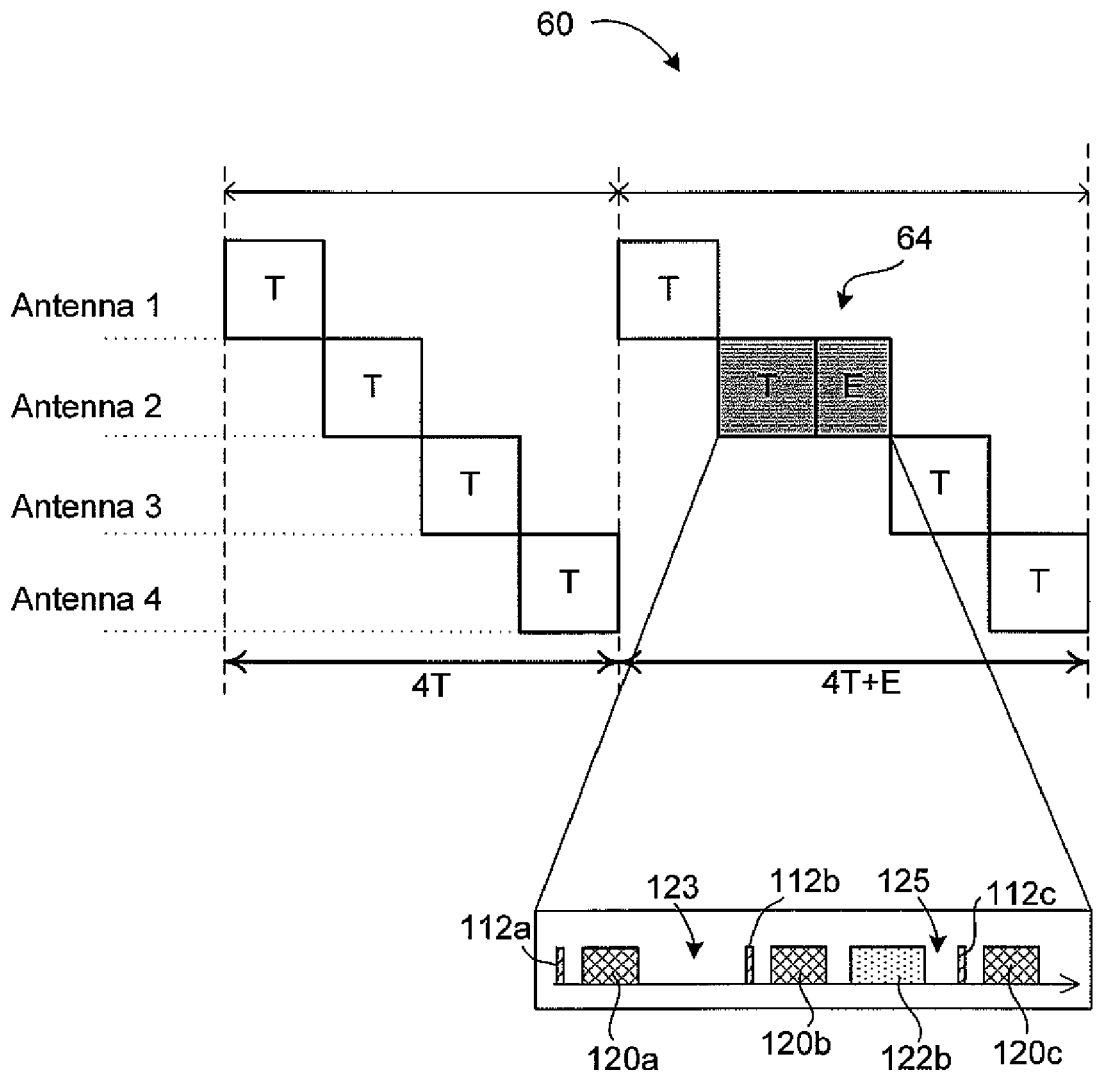
FIG. 7 shows an example using the adaptive scanning pattern of FIG. 3.

Now reference is made to FIG. 7, which shows an example using the adaptive scanning pattern 60. In an embodiment of the adaptive scanning pattern 60, the presence of a transponder is detected in timeslot 64 when the reader transmits a trigger signal 112*a* and receives a response signal 120*a*.

Based upon receipt of the response signal 120*a*, the timeslot 64 is allocated an extended duration T+E. The duration T+E, in this embodiment, is sufficiently long for the reader to perform the "read", "program" and "verify" operations in a single cycle. Within timeslot 64, after receipt of the response signal 120*a*, the reader performs its analysis and calculations in connection with the ETC transaction. Following a delay 123, the reader sends a trigger signal 112*b*, receives a response signal 120*b*, and sends a program signal 122*b*. A further delay 125 allows the transponder time to demodulate and implement the changes to its transponder information as instructed in the program signal 122*b*. The reader then sends another trigger signal 112*c* and receives another response signal 120*c*. The reader may then verify that the transponder information is up-to-date.

By extending the timeslot duration for an active antenna, the adaptive scanning pattern 60 facilitates completion of the reader-transponder ETC transaction in fewer cycles. Variations on the above example will be apparent to those of ordinary skill in the art.

Figure 8:
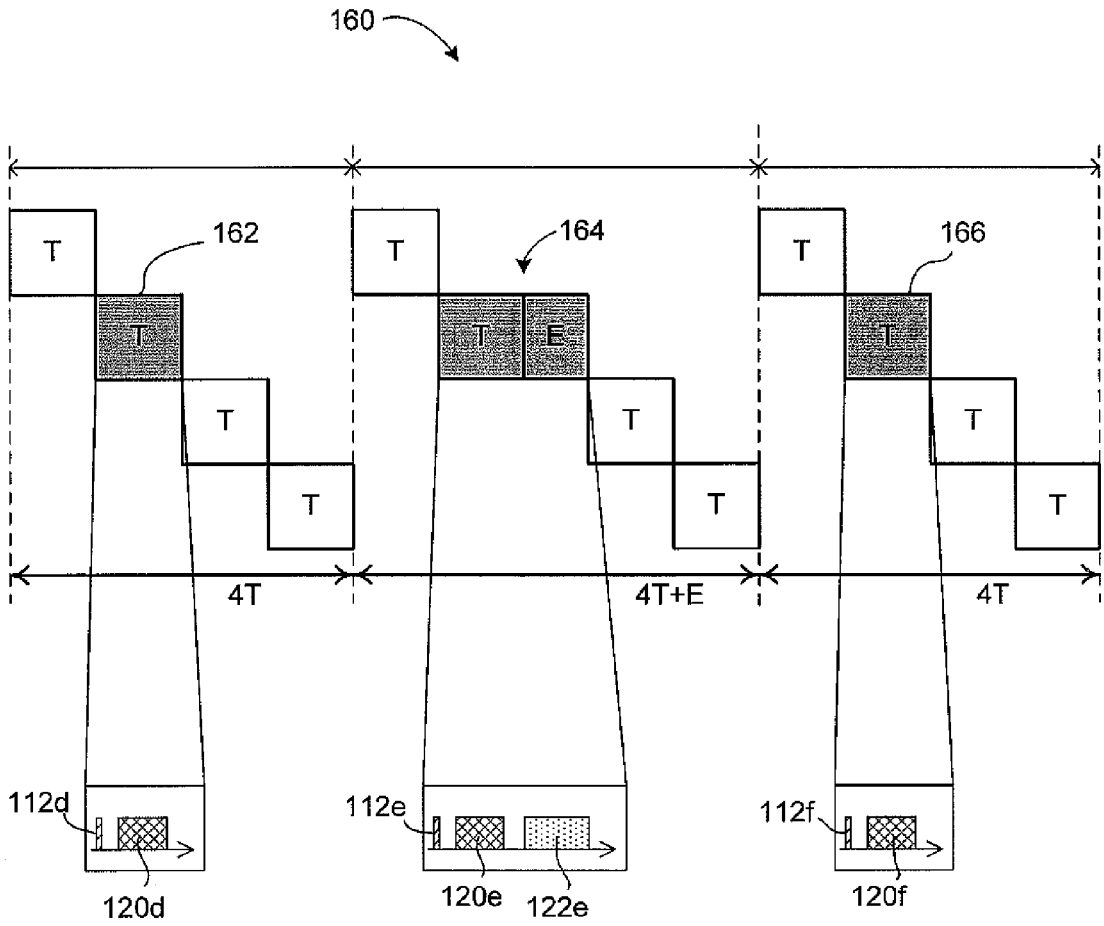
FIG. 8 shows another example using the adaptive scanning pattern of FIG. 3.

Reference is now made to FIG. 8, which shows three cycles of a second embodiment of an adaptive scanning pattern 160. In this embodiment, the default duration T of each timeslot is sufficient to conduct a "read" or "verify" operation, but not a "program" operation. In other words, the empty programming period 118 (FIG. 5B) is dropped from the read and verify operations. In one embodiment, the duration T of each timeslot may be less than 1 ms.

As shown in timeslot 162, the reader broadcasts a trigger signal 112*d* and receives a response signal 120*d* over the duration T of the timeslot 162. In the next cycle, a timeslot 164 of duration T+E is allocated to the same antenna. The extra time E is sufficiently long to permit the reader to send a trigger signal 112*e*, receive a response signal 120*e*, and send a program signal 122*e*. In the third cycle, a timeslot 166 of default duration T is allocated to permit the reader to perform a verify operation by sending a trigger signal 112*f* and receive a response signal 120*f*.

This embodiment allows for faster cycle time of the overall scanning pattern by shortening the timeslot duration T for each antenna. The timeslot duration is then dynamically extended if a transponder is present to allow for sufficient time to perform programming of the transponder.

Figure 9:
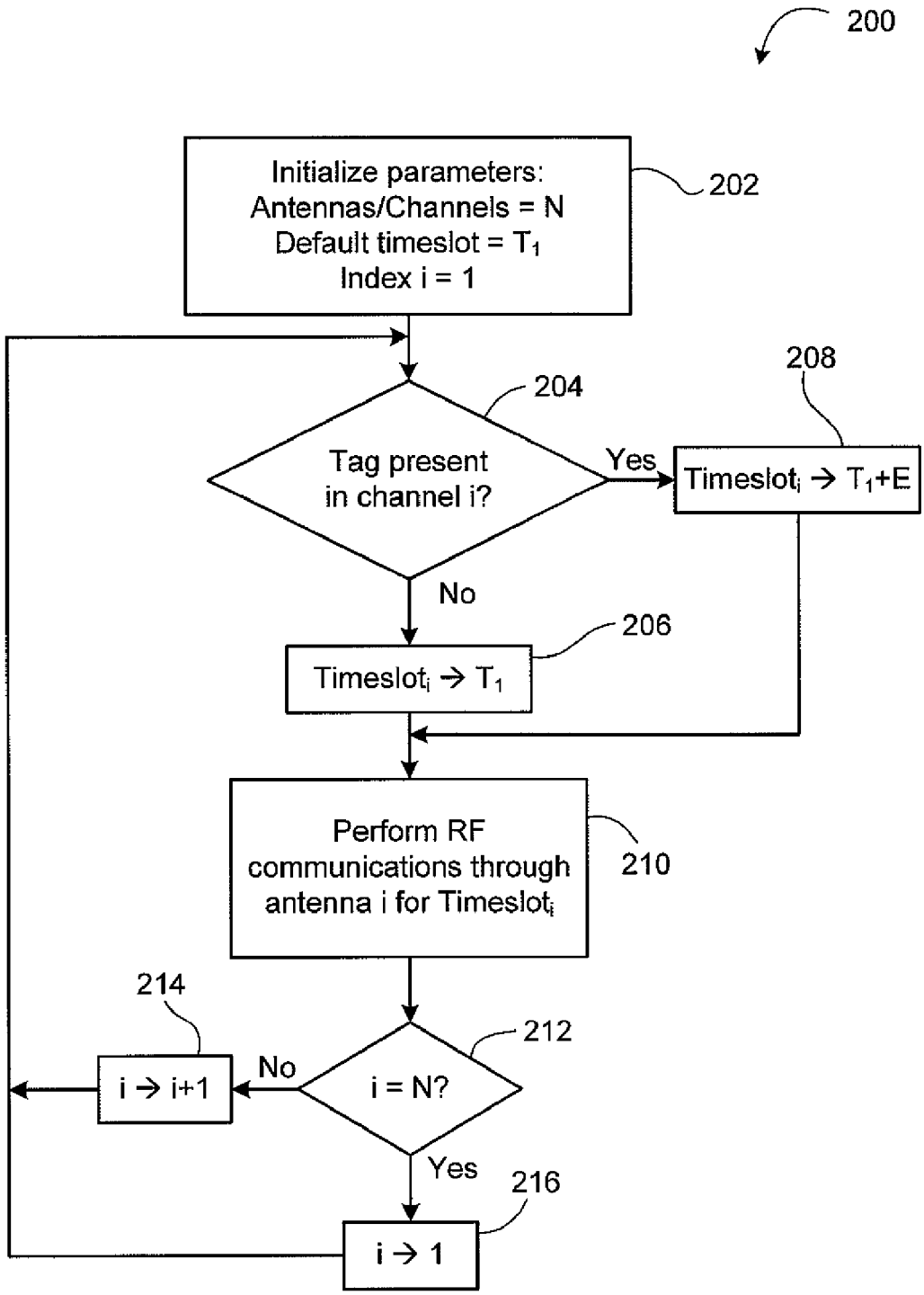
FIG. 9 shows, in flowchart form, a method of dynamically adapting a scanning pattern within an ETC system.

Reference is now made to FIG. 9, which shows a method 200 of dynamically adapting a scanning pattern within an ETC system. It will be appreciated that the method 200 is implemented within the reader of an ETC system. More particularly, it will be appreciated that the method 200 reflects the operation steps of the reader in dynamically adjusting the timeslot duration allocated to each antenna in a multi-antenna ETC system. The excitation of the antennas is time-multiplexed. It will be appreciated that two or more antennas in the system may be excited at the same time if sufficiently spatially separated. In such a case the reader may process their respective signals in parallel. In one embodiment, more than one reader may be provided, each being dedicated to controlling a subset of the antennas.

The method 200 begins in step 202 with the initialization of certain parameters. For example, the number antennas or channels may be set to N, the default length $T_1$ of a timeslot may be set, and an indexing variable i may be initialized at 1.

In step 204, for antenna/channel i the reader assesses whether a tag (transponder) was present when the antenna/channel i was previously scanned. If a response signal was received by the antenna i during its most recent (or, in some embodiments, current) timeslot, then a tag is present and the method 200 proceeds to step 208. In step 208, the timeslot for the antenna I is extended to a duration of $T_1$+E. If there is no tag present in the capture zone for the antenna i during its most recent (or current) scan, then in step 206 the timeslot duration for antenna i is set to $T_1$. The presence or absence of a tag in the capture zone for an antenna may be tracked using a register or memory location in which one bit is allocated to each antenna. In one embodiment, a bit set to zero indicates no tag in the previous scan and a bit set to one indicates a tag was present in the previous scan (or is present in the current scan).

In step 210, the reader performs its RF communications in accordance with the defined protocol over the timeslot allocated for antenna i. The timeslot may have a duration $T_1$ or a duration $T_1$+E, depending on the results of steps 204, 206, 208. If the timeslot has a duration $T_1$, then the RF communications must be completed within this duration. If the timeslot has a duration $T_1$+E, then there is additional time in which to conduct RF communications. This may permit the reader to perform additional "read", "program" or "verify" operations, in some embodiments.

Following step 210, the reader determines whether it has cycled through all N antennas in step 212 and, if not, it increments the index variable i in step 214. Otherwise, it resets i in step 216 so as to begin the cycle anew. The method 200 then continues by returning to step 204.

It will be appreciated that the method 200 may be modified such that the timeslot extension E is added only for the program cycle of an RPV-type communication, as illustrated in FIG. 8.

Figure 10:
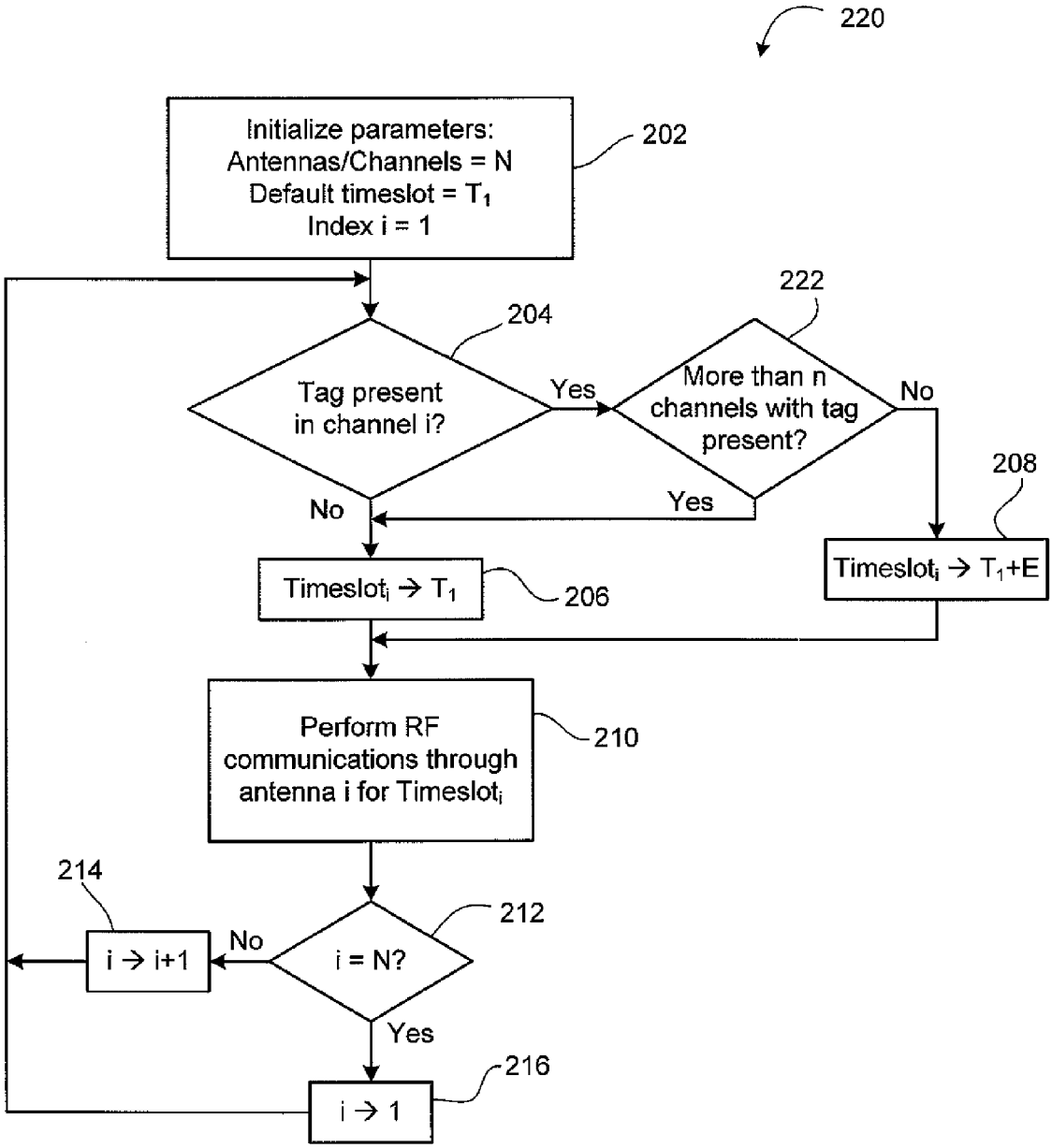
FIG. 10 shows, in flowchart form, a modified method for dynamically adapting a scanning pattern within an ETC system.

Reference is now made to FIG. 10, which illustrates a modified method 220 for dynamically adapting a scanning pattern within an ETC system. The steps of method 220 are largely identical to the steps of method 200 (FIG. 9) and, to the extent they are the same, will not be explained again. However, following step 204, when there was a tag present in the capture zone of antenna i—i.e. a response signal was received in reply to the most recent trigger signal from antenna i—in step 222 the reader assesses whether more than n channels/antennas also have tags present. If so, then the method 220 proceeds to step 206 and the timeslot duration remains the default duration $T_1$. Otherwise, the method 220 proceeds to step 208 to lengthen the timeslot for antenna i. For example, in a 4 antenna system, the variable n may be set to 2, such that if there are more than 2 channels with tags present, then no channels will get extended. The intention of this step 222 is to impose a condition on extending the timeslot duration that the antenna i be experiencing a higher volume/demand than at least one or more other antennas. Without this condition, a situation could arise wherein all the antennas have a tag present and all antennas are allocated an extended duration timeslot of length $T_1$+E. It will be appreciated that in some embodiments this may be appropriate, such as an embodiment implementing a scanning pattern akin to that shown in FIG. 8 since the extended timeslot may be necessary to complete a programming operation.

Figure 11:
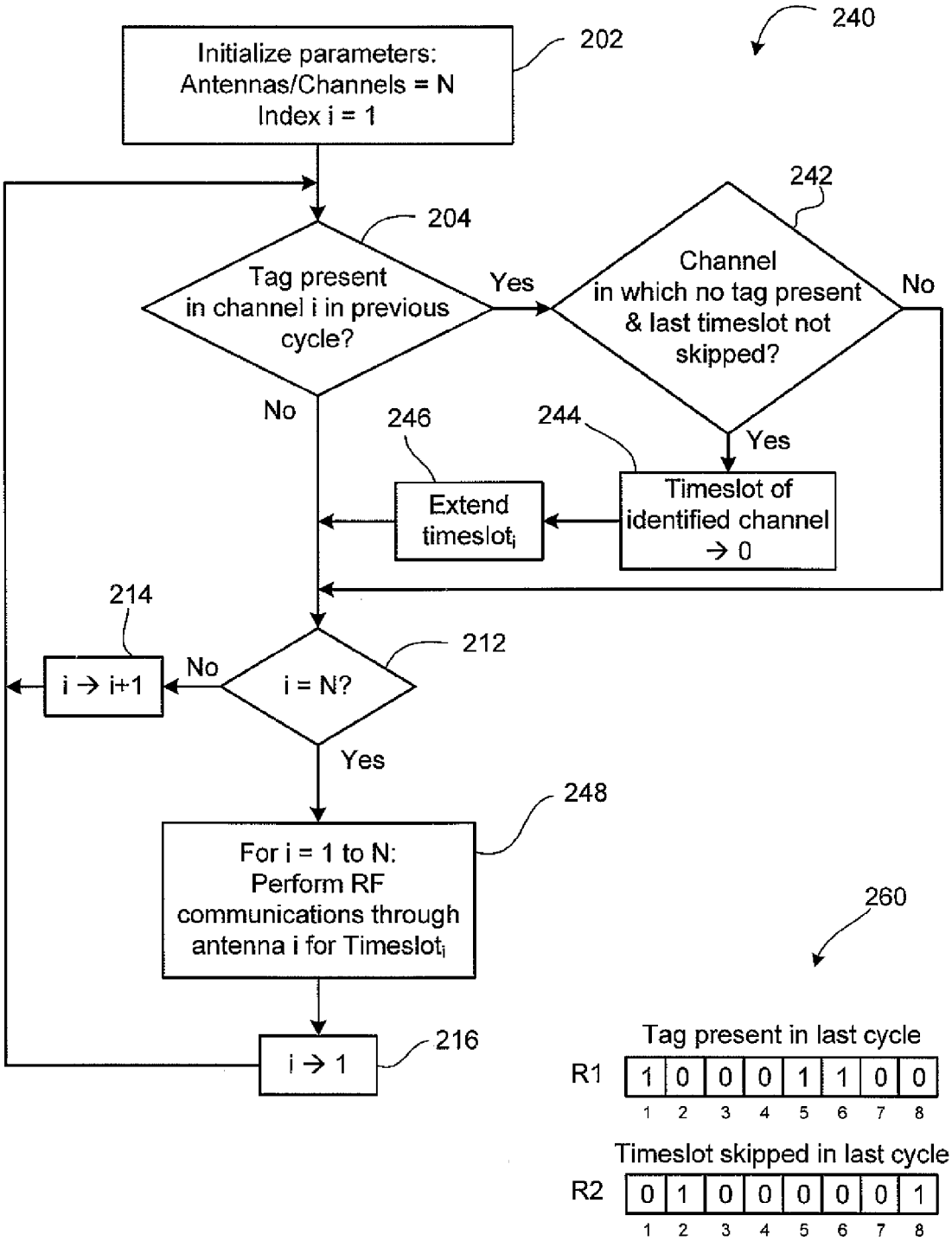
FIG. 11 shows, in flowchart form, another method for dynamically adapting a scanning pattern within an ETC system.

Yet another method 240 for dynamically adjusting a scanning pattern in an ETC system is shown in FIG. 11. The method 240 includes some steps similar to the steps of method 200 (FIG. 9) and, to the extent they are the same, they not be explained in detail again. Method 240 implements the "skipped" or "stolen" timeslot procedure illustrated in FIG. 4.

Following step 204, when it is determined that a tag is present in the capture zone of antenna i during the previous scan, then in step 242 the reader determines whether there are any channels/antennas that did not have a tag present in their previous scan. In this step 242 the reader also tries to identify any of those antennas had their timeslot skipped/stolen in the previous cycle. If an identified channel/antenna meets the criteria—i.e. if it was not skipped in the previous cycle and no transponder was present in its capture zone—then the method 240 proceeds to step 244, where the identified channel is flagged to be skipped. The timeslot of antenna i is then extended by $T_1$ in step 246. An additional condition may be imposed in step 242 that the identified channel not already by flagged to be skipped in the present cycle. The method 240 may be implemented such that the assessment steps 204, 242, 244, 246 are repeated for all antennas at the beginning of each cycle, as implemented through steps 212 and 214.

Once the method 240 cycles through all antennas from 1 to N and determines which antennas should have their timeslots stolen and which should have their timeslots lengthened, then the method 240 continues in step 248 wherein the scanning pattern is implemented. The reader cycles through the antennas 1 to N in the time-multiplexed scanning pattern performing RF communications within the timeslots allocated though the procedure of steps 204, 242, 244, and 246. Following the scanning pattern, the index i is reset to 1 in step 216 and the method 240 returns to step 204 to repeat the cycle.

FIG. 11 also illustrates an example embodiment of registers 260 for tracking data regarding the antennas. For example, in an embodiment in which the number of antennas N=8, a register R1 may track whether a tag was present in the last cycle. A tag was present if a response signal was received by the antenna during the antenna's timeslot. A 1 bit indicates a tag was present and a 0 bit indicates that no tag was present. Similarly, register R2 indicates whether the antenna's timeslot was skipped in the previous cycle. A 1 bit indicates a skipped timeslot whereas a 0 bit indicates the timeslot was not skipped. Based on the content of the registers 260, the reader may be able to identified antennas that require extra timeslots and antennas that are candidates for having their timeslot stolen for a cycle.

For example, as shown in FIG. 11, register R1 indicates that a tag was present with respect to antennas 1, 5, and 6. These antennas may require an extra timeslot. Register R2 indicates that the timeslots of antennas 2 and 8 were stolen in the previous cycle. In this embodiment, timeslots cannot be stolen for two consecutive cycles, so antennas 2 and 8 cannot surrender their timeslots. Based on the registers 260, antennas 3, 4, and 7 may have their timeslots stolen to supply extra timeslots to antennas 1, 5, and 6. One option for identifying the candidate timeslots is to perform a bitwise NOR of the registers. Other techniques for tracking data regarding the antennas and identifying and selecting antennas to lose a timeslot will be understood by those skilled in the art in light of the foregoing discussion.

It will be appreciated that the decision to extend a timeslot or steal a timeslot is partly based upon the presence of a transponder in the capture zone for a given antenna. In some embodiments, this decision may be implemented for the timeslot in which the transponder is first detected. In other embodiments, this decision may be implemented in the cycle following the one in which the transponder is first detected. Suitable modifications to the foregoing methods may be made to accommodate either scenario.

Figure 12:
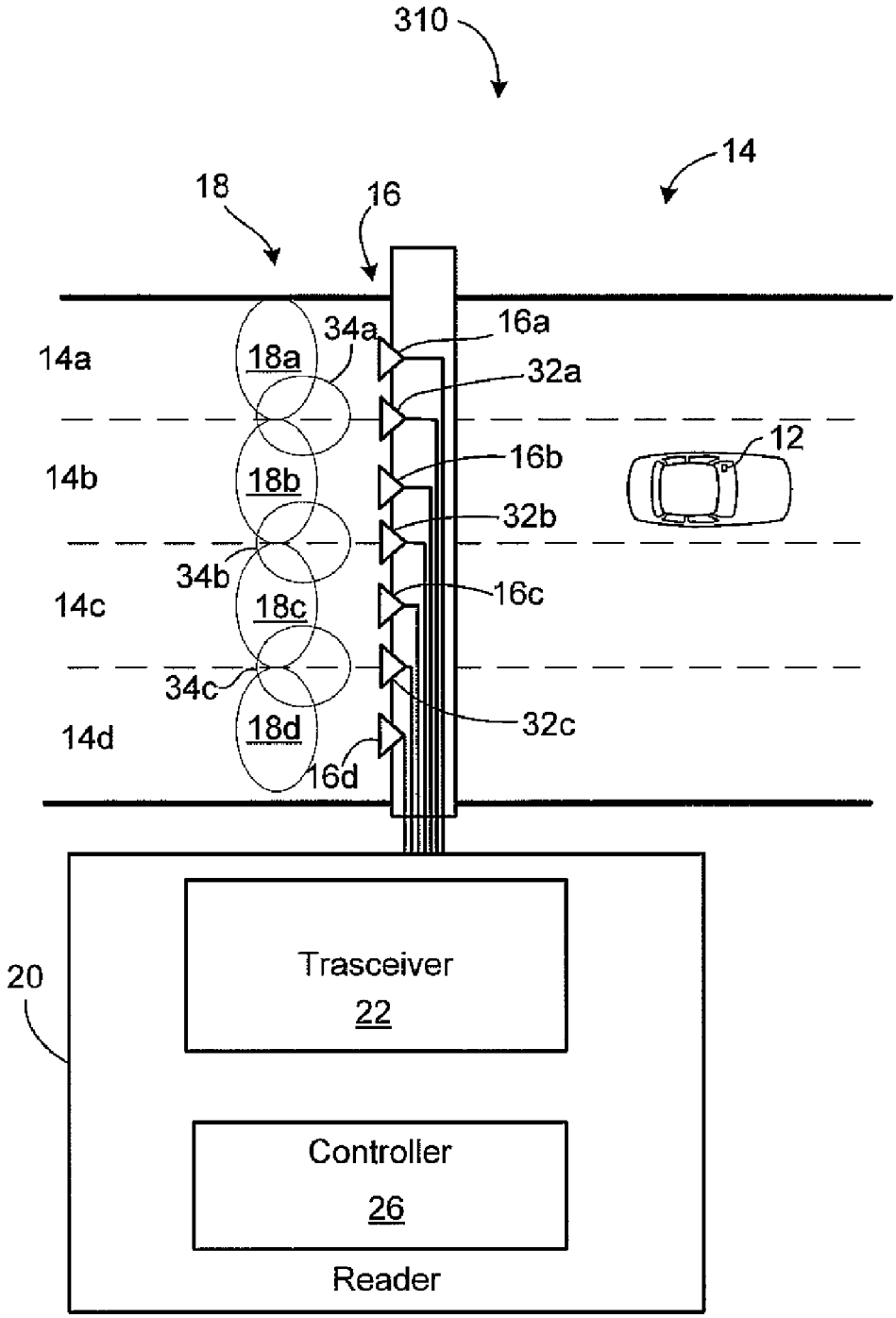
FIG. 12 shows a block diagram of another embodiment of an electronic toll collection system.

Reference is now made to FIG. 12, which shows a block diagram of a further embodiment of an electronic toll collection system 310. The ETC system 310 is similar to the ETC system 10 shown in FIG. 1, except that the ETC system 310 also includes mid-lane antennas 32 (shown individually as 32*a*, 32*b*, and 32*c*). The mid-lane antennas 32 are positioned on the gantry approximately between lanes of traffic. They each define a capture zone 34 (shown as 34*a*, 34*b*, 34*c*) that is roughly centered between adjacent capture zones 18 of the center lane antennas 16.

As will be appreciated by those of ordinary skill in the art, the mid-lane antennas 34 ensure greater coverage of the roadway 14; however, they may be considered of lesser importance than the center lane antennas 16 since the majority of vehicles 12 travel within one of the lanes of the roadway 14 and only straddle lanes when performing a lane change. Accordingly, the scanning pattern implemented by the reader 20 may reflect this by allocating a smaller proportion of the overall transmission time to each mid-lane antenna 32 than is allocated to each center lane antenna 16.

Figure 13:
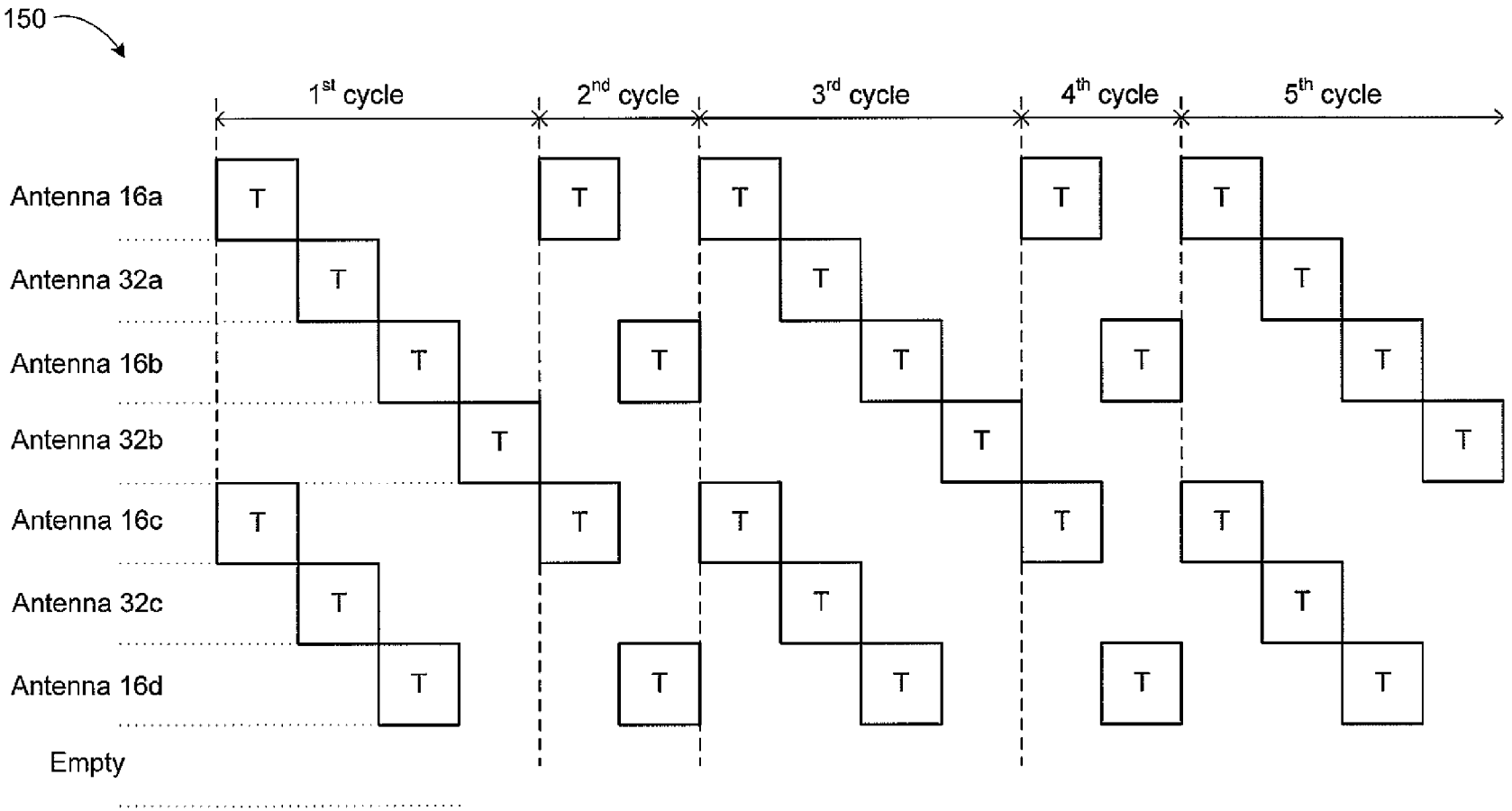
FIG. 13 shows an embodiment of an unbalanced scanning pattern for an ETC system.

Reference is made to FIG. 13, which shows an embodiment of an unbalanced scanning pattern 150 in which the center lane antennas 16 are given a greater number of timeslots than the mid-lane antennas 32. This may be implemented by skipping the timeslots of the mid-lane antennas 32 periodically. For example, the mid-lane antennas 32 may only receive a timeslot every second cycle.

In the embodiment shown in FIG. 13, there are seven antennas—four center lane antennas 16 and three mid-lane antennas 32. Due to spatial separation, the reader may excite more than one antenna at a time. In some embodiments, there may be two separate readers for simultaneously exciting the two antennas and processing the received responses.

It will also be understood by those of ordinary skill in the art that to the extent that the ETC system includes a lane determination system that relies upon transmission counts (a count of trigger-response episodes) to perform lane assignments, the count/determination algorithms may presume a fixed timeslot and scanning pattern. To the extent that an adaptive scanning pattern is implemented, the lane determination system may also require an adaptive algorithm for adjusting the weighting assigned to counts from various antennas based upon their relative proportions of the scanning patterns.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An electronic toll collection system for conducting toll transactions with vehicles travelling in a roadway, the system comprising:

a plurality of directional antennas, each antenna defining a coverage zone within the roadway; and a reader, the reader comprising at least one transceiver for propagating an RF signal through said antennas and receiving RF response signals through said antennas, and a controller for controlling the at least one transceiver to individually excite each antenna with the RF signal in accordance with a time-multiplexed cyclical scanning pattern, wherein the scanning pattern is configured to allocate each antenna an equal length proportion of a cycle of the scanning pattern for conducting RF communications, and wherein the controller includes an adaptive scanning module configured to dynamically modify the scanning pattern to allocate a longer proportion of at least one cycle of the scanning pattern to one of the antennas than is allocated to at least one of the other antennas on the basis of receipt of a response signal by said one of the antennas.

2. The electronic toll collection system claimed in claim 1, wherein each cycle of said scanning pattern includes a timeslot for each of said antennas, and wherein said adaptive scanning module is configured to lengthen the timeslot for said one of the antennas.

3. The electronic toll collection system claimed in claim 2, wherein said adaptive scanning module is configured to lengthen the timeslot for said one of the antennas by stealing a timeslot from one the other antennas within the cycle, such that the duration of the resulting cycle remains constant.

4. The electronic toll collection system claimed in claim 3, wherein said adaptive scanning module is configured to steal said timeslot by identifying a candidate antenna from which to steal said timeslot by determining that said candidate antenna did not receive a response from a transponder within a most recent cycle of said scanning pattern.

5. The electronic toll collection system claimed in claim 4, wherein said adaptive scanning module is configured to further impose a condition that said candidate antenna did not have its timeslot stolen in the most recent cycle of said scanning pattern.

6. The electronic toll collection system claimed in claim 1, wherein said adaptive scanning module is configured to allocate said longer proportion on a condition that at least one of said other antennas did not receive a response from a transponder within a most recent cycle of said scanning pattern.

7. The electronic toll collection system claimed in claim 1, wherein said RF communications comprise communications in accordance with a predefined protocol, wherein said protocol prescribes a read operation, a program operation and a verify operation, and wherein said longer proportion enables said reader to perform said read operation, said program operation and said verify operation in a single timeslot.

8. The electronic toll collection system claimed in claim 1, wherein said RF communications comprise communications in accordance with a predefined protocol, wherein said protocol prescribes a read operation, a program operation and a verify operation, and wherein said equal length proportion is sufficiently long to enable said read operation and said verify operation, and wherein said longer proportion is required to perform said program operation.

9. A method of adaptively modifying channel bandwidth in an electronic toll collection system, the system including a plurality of antennas connected to a reader, the reader including at least one transceiver for conducting RF communications through the antennas, the RF communications including propagating an RF signal and receiving response signals, the method including the steps of:

individually exciting each antenna with the RF signal in accordance with a time-multiplexed cyclical scanning pattern, the scanning pattern allocating each antenna an equal length proportion of a cycle of the scanning pattern for conducting the RF communications;

receiving a response signal from a transponder through one of the antennas; and allocating a longer proportion of at least one cycle of the scanning pattern to said one of the antennas than is allocated to at least one of the other antennas.

10. The method claimed in claim 9, wherein each cycle of said scanning pattern includes a timeslot for each of said antennas, and wherein said step of allocating comprises lengthening the timeslot for said one of the antennas.

11. The method claimed in claim 10, wherein said step of lengthening comprises stealing a timeslot from one the other antennas within the cycle, such that the duration of the resulting cycle remains constant.

12. The method claimed in claim 11, wherein said step of stealing comprising identifying a candidate antenna from which to steal said timeslot, and wherein said step of identifying comprises determining that said candidate antenna did not receive a response from a transponder within a most recent cycle of said scanning pattern.

13. The method claimed in claim 12, wherein said step of identifying further comprises determining that said candidate antenna did not have its timeslot stolen in the most recent cycle of said scanning pattern.

14. The method claimed in claim 9, wherein said step of allocating includes determining that at least one said other antennas did not receive a response from a transponder within a most recent cycle of said scanning pattern.

15. The method claimed in claim 9, wherein said RF communications comprise communications in accordance with a predefined protocol, wherein said protocol prescribes a read operation, a program operation and a verify operation, and wherein said longer proportion enables said reader to perform said read operation, said program operation and said verify operation in a single timeslot.

16. The method claimed in claim 9, wherein said RF communications comprise communications in accordance with a predefined protocol, wherein said protocol prescribes a read operation, a program operation and a verify operation, and wherein said equal length proportion is sufficiently long to enable said read operation and said verify operation, and wherein said longer proportion is required to perform said program operation.

* * * * *